US005631614A

United States Patent [19]

Goodman et al.

[11] Patent Number: 5,631,614

[45] Date of Patent: May 20, 1997

[54] MAGNETIC SELF-LATCHING ELECTRIC CONTACT

[75] Inventors: George C. Goodman, Niskayuna; Nelson R. Corby, Jr., Scotia, both of N.Y.

[73] Assignee: General Electric Company, Schenectady, N.Y.

[21] Appl. No.: 566,212

[22] Filed: Dec. 1, 1995

[51] Int. Cl.[6] ..... H01H 9/00

[52] U.S. Cl. ..... 335/177; 335/132; 335/179

[58] Field of Search ..... 335/132, 202, 335/35, 23–5, 177–9

[56] References Cited

U.S. PATENT DOCUMENTS 4,893,102 1/1990 Bauer ..... 335/132

5,374,912 12/1994 Houck, III ..... 335/132

*Primary Examiner*—Lincoln Donovan

*Attorney, Agent, or Firm*—Donald S. Ingraham

[57] ABSTRACT

A contactor device includes a magnetic latch apparatus to reduce bounce between contact pads on closing. The magnetic latch apparatus includes a first magnet assembly and a second magnet assembly disposed so as to magnetically latch the first contact pad and second contact pad in the closed position. The first and second magnet assemblies typically are disposed respectively on the first contact pad carrier and second contact pad carrier such that the distance between the first and second magnet assemblies corresponds to the distance between the first and second contact pads. The magnet assemblies have a latch element that is a permanent magnet, an electromagnet, or a magnetically attracted material. A method of securing together a first and a second contact pad in a contactor device in accordance with this invention includes the step of disposing a first magnet assembly in a latch position with respect to a second magnet assembly in correspondence with the positioning of the first contact pad in a closed position with respect to the second contact pad and magnetically latching the first and second magnet assemblies together so as to maintain the first and second contact pads in the closed position.

12 Claims, 3 Drawing Sheets

MAGNETIC SELF-LATCHING ELECTRIC CONTACT

BACKGROUND OF THE INVENTION

Low voltage AC (alternating current) contactors are used in industrial and commercial applications to control power flow to electrical loads in circuits operating up to about 600 V RMS. Such electrical contactors typically have one or more contact pads disposed on a moveable pad carrier (or bridge) structure that is selectively moved between an open and a closed position. The pad carrier is typically driven by a solenoid acting in opposition to a spring such that the bridge contacts can make and break contact, depending on the bridge position, with corresponding stationary contacts. The voltage supply and load supply leads are attached to respective contacts so that when the pad carrier is moved such that the bridge contact pads are disposed in contact with the respective stationary contact pads the circuit is closed; to open the circuit the pad carrier assembly is moved to separate the bridge contact pads from the respective stationary contact pads.

One source of wear on contactor devices is "bouncing" that occurs when the contact pads are moved to the closed position, which normally results from rapidly displacing one contact pad from the open to the closed position. It is desirable that the movable contact pad be disposed in physical contact with the other contact pad as rapidly as possible so as to minimize the chance of arcing between the contact pads that might occur if the pads are moved slowly together. The rapid closure often results in the pad bouncing, that is, repeatedly physically touching and moving off of the other pad, over a period of a few milliseconds as it settles into the closed state. The bouncing of the contacts, and the arcing between contacts as they open slightly during the bounce, contribute to erosion of the contacts. Typically the contactor device includes a mechanical apparatus to reduce contact bounce, such as springs or dampers to decelerate the relay plunger near the end of travel. Such mechanical apparatus are not completely successful in eliminating bounce upon closure and often require periodic adjustment and replacement.

Contact bouncing results in increased wear on the contact pads from the mechanical action of the multiple closures and also from the electrical arcing that occurs when the contact pads physically separate during bounces. It is thus desirable to eliminate bouncing altogether in an electrical contactor.

SUMMARY OF THE INVENTION

In accordance with this invention a contactor device includes a magnetic latch apparatus to reduce significantly bounce between contact pads on closing. The contactor device includes a first contact pad disposed on a first carrier and a second contact pad disposed on a second pad carrier, at least one of the contact pad carriers being movably disposed so as to be selectively disposed in an open or closed position. The magnetic latch apparatus includes a first magnet assembly and a second magnet assembly disposed so as to magnetically latch the first contact pad and second contact pad in the closed position. The first and second magnet assemblies typically are disposed respectively on the first contact pad carrier and second contact pad carrier such that the distance between the first and second magnet assemblies corresponds to the distance between the first and second contact pads. The magnet assemblies have a latch element that is a permanent magnet, an electromagnet, or a magnetically attracted material. In one embodiment, an electromagnetic magnet assembly receives current shunted from current that is flowing between the first and second contact pads.

A method of securing together a first and a second contact pad in a contactor device includes the step of disposing a first magnet assembly in a latch position with respect to a second magnet assembly in correspondence with the positioning of the first contact pad in a closed position with respect to the second contact pad and magnetically latching the first and second magnet assemblies together so as to maintain the first and second contact pads in the closed position. In an embodiment in which electromagnetic latch mechanisms are used, the step of magnetically latching the first and second magnet assemblies together includes energizing the electromagnetic mechanism.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
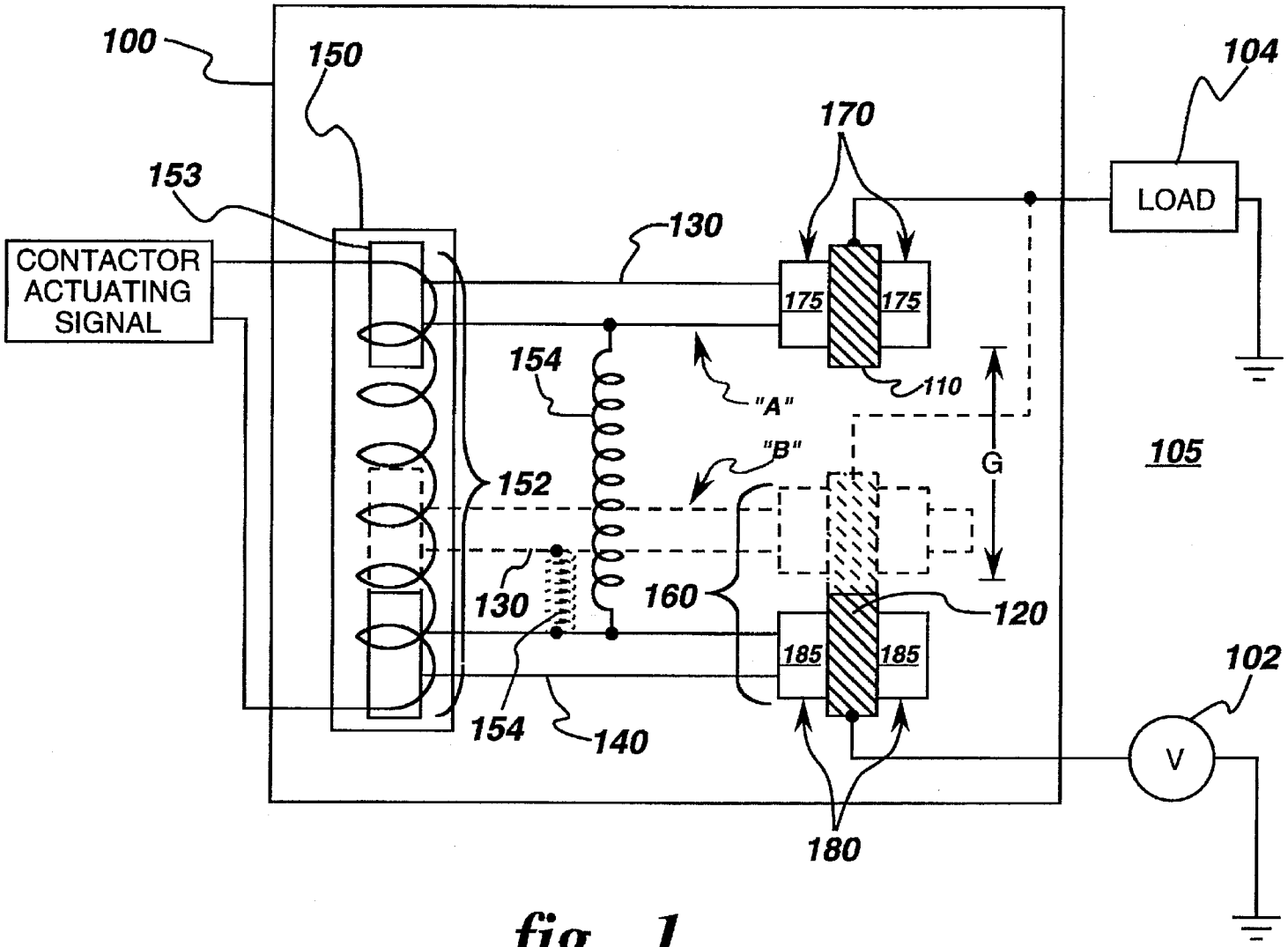
FIG. 1 is a part cross-sectional and part block diagram of a magnetic self-latching contactor device in accordance with one embodiment of this invention.

An electrical contactor device 100 (FIG. 1) is typically disposed in an electrical circuit 105 so as to selectively couple a voltage source 102 to one or more electrical loads 104. Contactor device 100 commonly is disposed integrally with load 104 but alternatively can be physically remote from electrical load 104, which may comprise any type of electrical load (e.g., having resistive, inductive, or capacitive elements). Electrical circuit 105 may comprise an alternating current or a direct current circuit.

Contactor device 100 comprises a first contact pad 110 and a second contact pad 120; by way of example and not limitation, as illustrated in FIG. 1, first (or load) contact pad 110 is electrically coupled to load 104 and second (or source) contact pad 120 is electrically coupled to voltage source 102. Source contact pad 110 and load contact pad 120 typically are of identical construction, and comprise a conductive material, for example, copper, silver, nickel, metal oxides, or mixtures of such materials to provide the combination of electrical conductivity and physical robustness required for a particular contactor application. The conductive material provides a contact pad material having characteristics of low contact welding, high electrical conductivity, low contact erosion, and controlled arc stability. The physical dimensions of contact pads 110, 120, are typically determined based upon the current carrying capacity of the contact pad as required by the particular rating of contactor 100. For example, for a size 2 NEMA rating (45 A), silver based contact pads 110, 120, each respectively comprising about 90% silver by weight, typically have a circular shape with a diameter of about 9 mm.

First contact pad 110 is disposed on a first pad carrier 130 and second contact pad 120 is disposed on a second pad carrier 140. Contactor device 100 further comprises a contact pad actuating mechanism 150, which typically comprises a solenoid 152 or similar magnetic-drive mechanism disposed in opposition to a spring 154. As illustrated in FIG. 1, first pad carrier 130 is coupled to a solenoid shaft 153 in solenoid 152 so as to be movable in correspondence with the action of solenoid 152. In an open position, designated by the letter "A" in FIG. 1, first and second contact pads are physically separated so that electrical circuit 105 is open; in the closed position, designated in the FIG. 1 by letter "B" (and drawn in phantom) first pad carrier 130 has been displaced (by solenoid 152) so that the first and second contact pads are in physical proximity to allow current flow to complete electrical circuit 105. By way of example and not limitation, actuating mechanism 150 is typically arranged such that upon energization of solenoid 152 solenoid shaft 153 is disposed in an extended position and in opposition to spring 154 such that first pad carrier 130 is displaced so that contact pad 110 is disposed in electrical and physical contact with second contact pad 120, thereby establishing an electrical connection between voltage source 102 and load 104. Upon deenergization of solenoid 152, spring 154 disposes solenoid shaft 153 in a position such that first pad carrier 130 is displaced such that second contact pad 120 are disposed in a position such that gap "G" exists between first contact pad 110 and second contact pad 120. Other arrangements to effect the desired selective displacement of the contact pads with respect to one another are possible as is known in the art, including, for example, displacement of both contact pad carriers 130 and 140.

In accordance with this invention, contactor device 100 further comprises a magnetic latch apparatus 160 having a first magnet assembly 170 and a second magnet assembly 180. First and second magnet assemblies are disposed in a spaced relationship with first and second contact pads 110, 120 so as to magnetically latch first and second contact pads 110, 120 in the closed position. As used herein, "magnetically latch" and the like refers to the use of magnetic force to prevent physical movement of first contact pad 110 away from second contact pad 120 when contactor device 100 is selected for the closed position. First magnet assembly 170 is disposed on first pad carrier 130 and second magnet assembly 180 is disposed on second pad carrier 140 such that the distance between the respect first and second magnet assemblies corresponds to the distance between first and second contact pads 110, 120. As illustrated in FIG. 1, first and second magnet assemblies 170, 180 typically are disposed in close physical proximity to first and second contact pads 110, 120, respectively; alternatively, first and second magnet assemblies 170, 180 are disposed at other positions along first and second pad carriers 130, 140 such that movement of first pad carrier 130 to the closed position results in the positioning of first magnet assembly in a position with respect to second magnet assembly so as to magnetically latch first and second contact pads 110, 120 in the closed position.

First magnet assembly 170 comprises a first assembly latch element 175, and second magnet assembly 180 comprises a second assembly latch element 185. The respective latch elements in a given magnetic latch apparatus 160 are selected such that the pair of assembly latch elements 175, 185, are magnetically attracted to each other with sufficient force when pad carrier 130 is in the closed position so as to provide the magnetic latching of first contact pad 110 to second contact pad 120. First assembly latch element 175 may comprise a permanent magnet or an electromagnet; alternatively, if second latch element 185 comprises a permanent magnet or an electromagnet, first assembly latch element may comprise a magnetically attracted material, that is, a material that is attracted to a magnetic force emanating from the opposing assembly latch element (e.g., such as steel or similar materials known in the art). Similarly, second latch element 185 may comprise a permanent magnet or an electromagnet, and, if first latch element 175 is a permanent magnet or electromagnet, second latch element 185 may alternatively comprise a magnetically attracted material. First and second latch elements 175, 185, are disposed on their respective pad carriers 130, 140 so that they are magnetically attracted to one another (e.g., if first and second latch elements 175, 185 each comprise a permanent magnet, first and second latch elements are disposed so that opposite magnetic poles of the respective latch assemblies are in closest proximity when first pad carrier 130 is in the closed position.

Figure 2A:
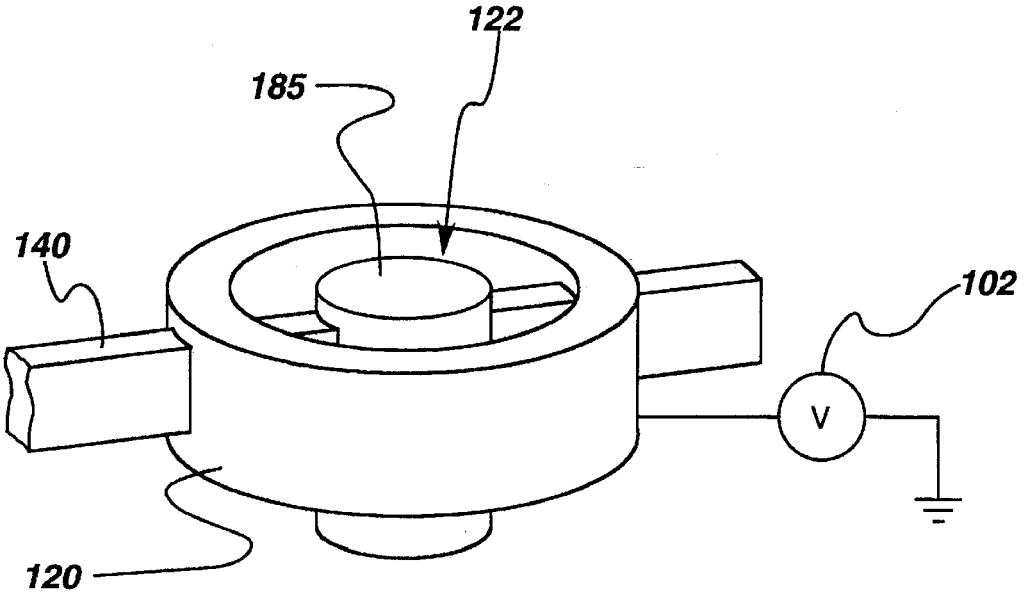
FIG. 2(A) is a perspective view of a magnetic latch assembly element in accordance with one embodiment of the present invention.
Figure 2B:
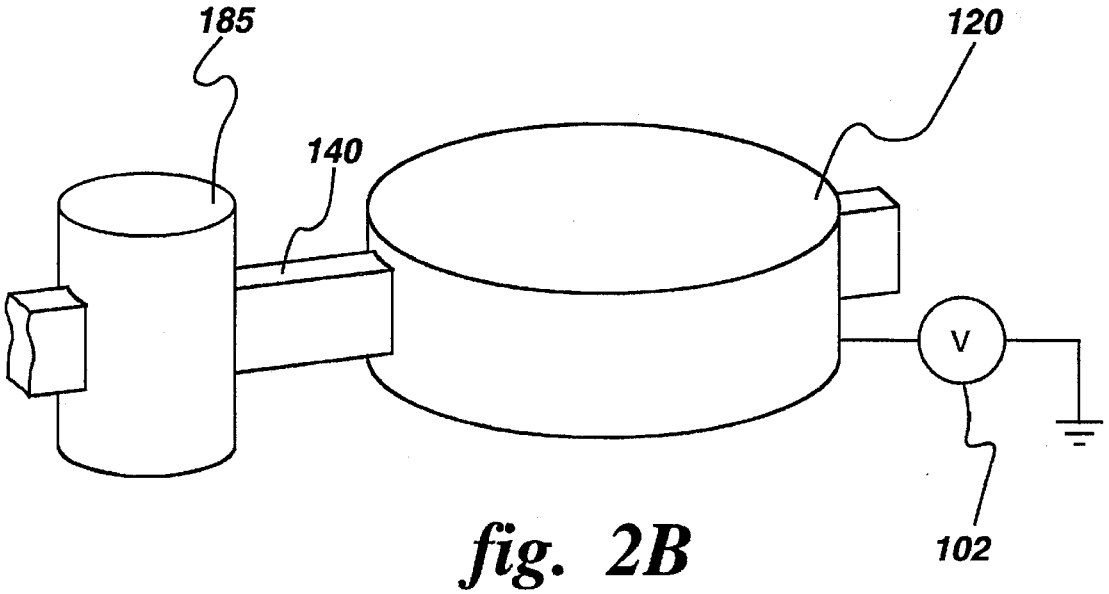
FIG. 2(B) is a perspective view of a magnetic latch assembly element in accordance with another embodiment of the present invention.

By way of example and not limitation, in accordance with one embodiment of the present invention, second (or source) contact pad 120 has an annular shape as illustrated in FIG. 2(A). Second assembly latch element 185 comprises a permanent magnet, or, alternatively, a magnetically attracted material if the corresponding first assembly latch element comprises a permanent magnet. In such an arrangement second latch element 185 is disposed within a region 122 surrounded by the annular structure of second latch element 185. Alternatively, as illustrated in FIG. 2(B), second assembly latch element 185 may be disposed adjacent on second pad carrier 140 spaced apart from second contact pad 120; the first magnet assembly latch element (not shown) would be disposed a similar distance from the first contact pad on the first pad carrier so that the first and second magnet assembly latch elements mated together when the contactor was disposed in the closed position.

Figure 3:
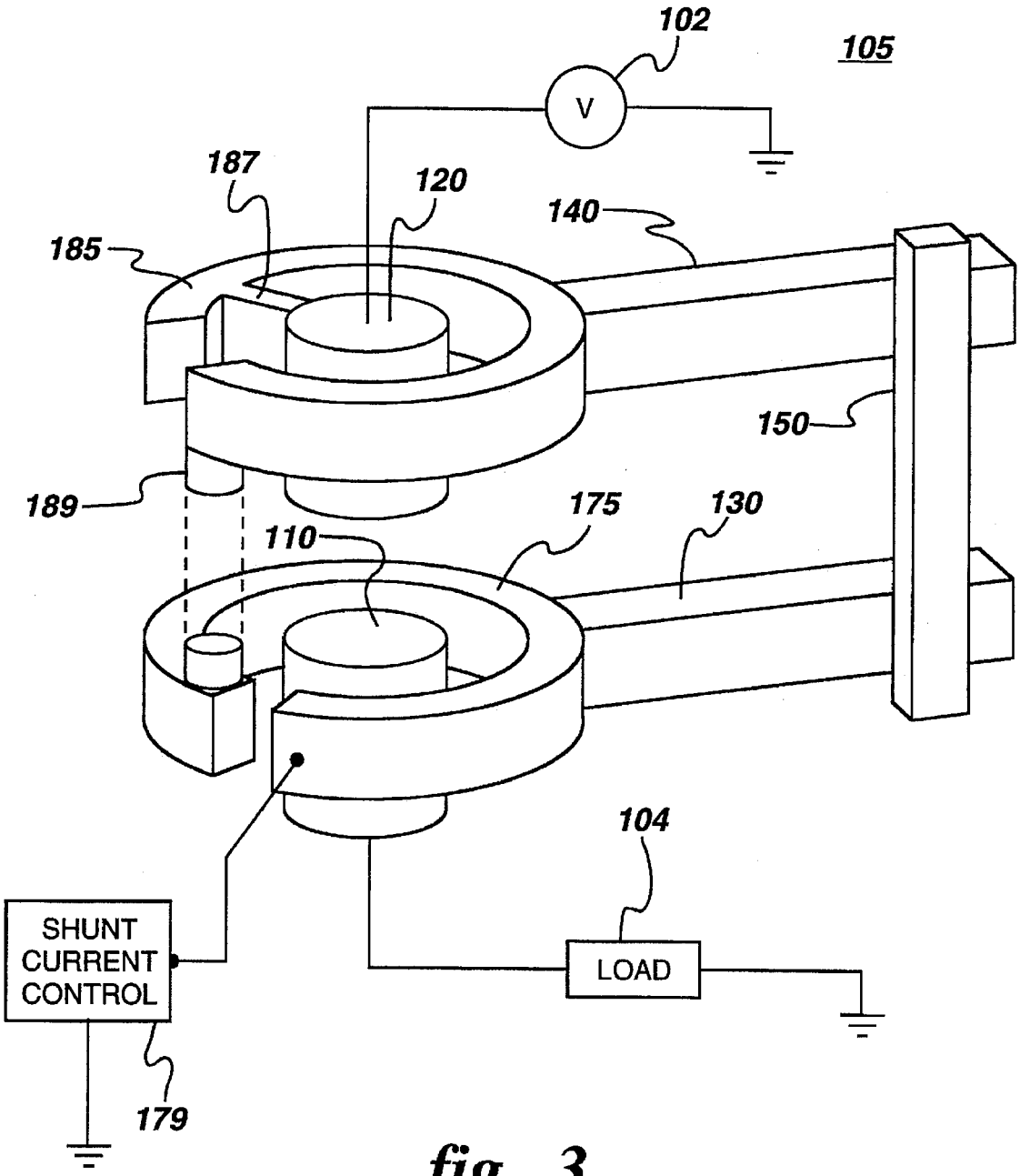
FIG. 3 is a perspective view of a electromagnetic latch assembly element in accordance with another embodiment of the present invention.

In another embodiment of the present invention, one assembly latch element comprises an electromagnet and the other assembly latch element comprises a magnetically attracted material. By way of example and not limitation, as illustrated in FIG. 3, second magnet assembly latch element 185 comprises an electromagnet. The source of electrical current to the electromagnet can be derived from any appropriate source, including current flowing in electrical circuit 105 when first and second contact pads are in the closed position (or close enough thereto) to allow current flow in the circuit. For example, second magnet assembly latch element 185 comprises an annular-shaped split coil that is electrically coupled at one end to second contact pad 120 via a shunt element 187. At or near the opposite end of the split coil latch element 185, a second magnet assembly contact point 189 is disposed on the side of latch element 185 that is disposed toward the corresponding first latch element 175 on first pad carrier 130. First latch element 175 similarly comprises an annular shaped split ring, and first latch element 175 comprises a first magnet assembly contact point 177 that is disposed on a surface of latch element 175 disposed towards the second magnet assembly latch element such that when the contactor device is in the closed position, first magnet assembly contact point 177 is disposed in physical contact with second magnet assembly 189 so as to allow electrical current flow therethrough. First magnet assembly contact point 177 and second magnet assembly contact point 189 protrude from the surfaces of the respective latch elements such that when first and second contact pads 110, 120 are in contact (closed position), the only electrical contact between first magnet assembly latch element 175 and second assembly latch element 185 is through the respective contact points 177, 189.

Thus, when solenoid device 150 is actuated to move one or more pad carrier arms to the closed position, once first and second contact pads 110, 120 come in electrical contact and current begins to flow, some portion of that load current is shunted off to energize electromagnetic latch elements 175 and 185. The current flow is from source contact pad 185, through shunt element 187 and second magnet assembly annular-shaped split coil 185, and thence into first magnet assembly split coil latch element via the first and second magnet assembly contact points 177, 189. First magnet assembly latch element 175 is further electrically coupled to a shunt current control device 179. Shunt current control device comprises elements, such as resistors or variable resistors, to determine the amount of electrical current that is shunted from the load current to the electromagnetic latch elements 175, 185. Once the electromagnet element is energized by the flow of electrical current, the resultant magnetic field serves to attract first and second magnet assembly latch elements together so as to magnetically latch together the first and second contact pads 110, 120.

In operation, an actuating signal (e.g., from a relay responsive to a command to energize load 104 (FIG. 1)) is applied to actuating mechanism 150 that causes the solenoid plunger 153 to be displaced in a manner that results in first contact pad 110 (by acting on first pad carrier 130 to which first contact pad is mounted) to be driven towards second contact pad 120. Simultaneous with the movement of contact pad 110, first magnet assembly 170 is similarly moved closer to second magnet assembly 180 in correspondence with the positioning of the contact pads. First and second magnet assemblies then magnetically latch first contact pad to second contact pad in the closed position; the attractive magnetic forces between the first and second magnet assemblies serve to lock the first and second contact pads together in physical contact so as to reduce bouncing that otherwise would result when the moving pad carrier (e.g., first pad carrier 130) rebounded from the sudden deceleration upon the two contact pads coming into physical contact. The reduced bouncing results in less wear on the contact pads and further reduces arcing between the contacts that results when the contacts bounce between physical contact and separation after a closing contactor device closing evolution without magnetic latch apparatus 160. Magnetic latch apparatus 160 comprises permanent magnets or electromagnets to provide the magnetic field that provides the attraction between first magnet assembly 170 and second magnet assembly 180. When electromagnets are used, the step of magnetically latching the first and second magnet assemblies together includes the step of energizing the electromagnet, such as by shunting a portion of the electrical current passing through the first and second contact pads 110, 120 into the electromagnet. A contactor with magnetic latch apparatus 160 can be unlatched in a conventional manner, for example, with an opening solenoid (not shown) or by action of kickout spring 154, which is of sufficient strength to overcome the magnetic attracting forces of latch apparatus 160 when solenoid assembly 150 is deenergized.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A magnetic self-latching contactor device having reduced bounce between contact pads upon closing, the contactor device comprising:

a first contact pad disposed on a first pad carrier, a second contact pad disposed on a second pad carrier, at least one of said first and second pad carriers being coupled to a contact pad actuating mechanism so as to move in response to a force supplied by said actuating mechanism, said first and second contact pads being movably disposed with respect to the other such that said first and second contact pads are selectively disposed in either a closed position such that both of said contact pads are in physical contact so that electrical current flows between the pads, or in an open position in which said first and second contact pads are physically separated from one another; and a magnetic latch apparatus having a first magnet assembly and a second magnet assembly disposed so as to magnetically latch said first contact pad and said second contact pad in said closed position, the latching effect of said magnetic latch apparatus being independent from force exerted by said contact pad actuating mechanism;

each of said first and second magnet assemblies comprising a respective assembly latch element that is selected from the group consisting of permanent magnets, electromagnets, and magnetically attracted material.

2. The device of claim 1 wherein said first magnet assembly is disposed on said first pad carrier and said second magnet assembly is disposed on said second pad carrier.

3. The device of claim 2 wherein said first and second magnet assemblies are respectively disposed on said first and second pad carriers such that the distance between said first and second magnet assemblies corresponds to the distance between said first and second contact pads.

4. The device of claim 1 wherein at least one of said first and second latch assemblies comprises a line-current supplied electromagnet, said line-current supplied electromagnet being coupled to shunt electrical current between said first contact pad and said second contact pad when current is passing between said first and second contact pads.

5. The device of claim 4 wherein said line-current supplied electromagnet comprises an electromagnet coil that is electrically coupled to one respective contact pad, said electromagnet coil being disposed in a spaced relation with respect to said respective contact pad.

6. The device of claim 4 wherein said line-current supplied electromagnet comprises an electromagnet coil that is electrically coupled to one respective contact pad, said electromagnet coil being integrally disposed with said respective contact pad.

7. The device of claim 6 wherein said electromagnet coil integrally disposed with said respective contact pad comprises a coil segment disposed around said contact pad, said coil having a first end and a second end, said first end of said coil segment being electrically coupled to said contact pad and said second end of said coil segment being electrically coupled to an electrical common contact such that a portion of current flowing through said respective contact pad is shunted through said coil segment so as to energize said coil segment as said electromagnet coil.

8. The device of claim 4 further comprising a shunt current control device that is adapted to govern the amount of electrical current that is shunted from said contact pad to said line-current supplied electromagnet.

9. A method of securing together a first contact pad and a second contact pad in a contactor device together so as to reduce bouncing between contact pads on closure of the contactor by action of a contact pad actuating mechanism, the method comprising the steps of:

disposing a first magnet assembly in a latch position with respect to a second magnet assembly in correspondence with the positioning of said first contact pad in a closed position with said second contact pad; and magnetically latching said first and second magnet assemblies together so as to hold said first contact pad in said closed position with respect to said second contact pad, the latching effect of said magnetic latch apparatus being independent from force exerted by said contact pad actuating mechanism.

10. The method of claim 9 wherein said first and second magnet assemblies each comprise an assembly latch element that is selected from the group consisting of permanent magnets, electromagnets, and magnetically attracted material.

11. The method of claim 10 wherein the step of magnetically latching further comprises the step of energizing an electromagnet to generate a magnetic field so as to latch said first and second magnet assemblies together.

12. The method of claim 11 wherein the step of energizing said electromagnet further comprises shunting a portion of the electrical current passing through said first and second contacts into said electromagnet.

* * * * *